United States Patent [19]

Zagorzycki

[11] 4,221,058

[45] Sep. 9, 1980

[54] HUMIDITY RESPONSIVE CONTROL FOR DRYERS

[75] Inventor: Peter E. Zagorzycki, Lansdale, Pa.

[73] Assignee: SCM Corporation, New York, N.Y.

[21] Appl. No.: 42,523

[22] Filed: May 25, 1979

[51] Int. Cl.[3] ..... F26B 21/08

[52] U.S. Cl. ..... 34/50; 34/54; 34/85; 34/89; 73/29; 73/421.5 R

[58] Field of Search ..... 165/16, 21; 73/421.5 A, 73/421.5 R, 29 R; 34/46, 50, 54, 47, 85, 89

[56] References Cited

U.S. PATENT DOCUMENTS

| | | | |
|---|---|---|---|
| 1,711,574 | 5/1929 | Miller | 34/46 |
| 2,643,464 | 6/1953 | Hadady | 34/48 |
| 2,920,398 | 1/1960 | Liljenstrom | 34/46 |
| 2,987,918 | 6/1961 | Hanna | 73/336.5 |
| 3,110,442 | 11/1963 | Taylor | 236/44 |
| 3,259,995 | 7/1966 | Powischill | 34/31 |
| 3,495,463 | 2/1970 | Howell | 73/421.5 A |
| 4,094,187 | 6/1978 | Navarre, Jr. | 73/421.5 A |

*Primary Examiner*—Larry I. Schwartz
*Attorney, Agent, or Firm*—Richard H. Thomas

[57] ABSTRACT

An improved control system, especially for dryers, adapted to sample dryer air, in a sample taking circuit, determine the moisture content of said air, and control the flow of make-up air to the dryer and exhaust air from the dryer in response to said moisture content. Means are provided for reducing the temperature of the dryer air in the sample taking circuit to one that can be handled by a signal producing means responsive to sample air moisture content. The flow of dryer air through said circuit is maintained by an aspirator and compressor combination, the compressor being adapted to provide purge air to the circuit before and/or after periods of sample taking.

10 Claims, 2 Drawing Figures

HUMIDITY RESPONSIVE CONTROL FOR DRYERS

The present invention relates to an improved control system for dryers, adapted to sample dryer air in a sample taking circuit, determine the moisture content of said air, and control the flow of make-up air to the dryer in response to said moisture content. The present invention resides specifically in components of and associated with the sample taking circuit.

BACKGROUND OF THE INVENTION

A vast majority of existing large commercial dryers, employed in the drying of foods and other products, employ a temperature determining means in the dryer and rely on automatic control of this parameter alone. The reason is that this is the easiest variable to control.

One problem is that control of temperature in a dryer does not automatically control flow of make-up air to the dryer. As the moisture content in the dryer increases, it is conventional practice to exhaust amounts of dryer air, usually on a continuous basis, and to bring make-up air into the dryer. The amount of desired exhaust flow obviously depends on the amount of evaporation occurring in the dryer. This typically varies during normal operation, and most dryers thus simply operate at excessive exhaust and make-up flows in order to insure that during periods of high evaporation there is sufficient exhaust flow. The amount of exhaust flow and introduction of make-up air is obviously a heat load in a drying oven, and operation at excessive exhaust and make-up flows represents a waste of energy and money. Increasing competitive pressures and unprecedented escalation of energy costs make more than minimal control of the dryer necessary.

In addition, it has been determined that operation of dryers at higher temperatures can result in substantial savings, making it feasible to determine the maximum allowable drying temperature permissible without product degradation, and to operate the dryer as close to product limits as possible. In most dryers, there is an initial constant rate drying period, and particularly during this period, the wet bulb temperature has a very strong influence on material temperature. This variable thus becomes an important consideration, in combination with temperature measurement, as a means for permitting operation at maximum temperature while at the same time insuring that high temperature operation does not result in such product degradation.

Systems are known for determining conditions in a dryer and compensating for changes in the humidity of the drying environment. Prior U.S. Pat. No. 3,259,995, filed by John W. Powischill and assigned to assignee of the present invention, describes a system for automatically controlling drying conditions to compensate for variations in moisture content within a dryer. However, direct measurement of humidity is not involved. In prior U.S. Pat. No. 3,110,442, by Roger K. Taylor, means are provided for obtaining a pressure variation reading in response to increased humidity and introducing fresh air of controlled humidity into a dryer as the pressure reaches a set point.

One problem with direct reading of humidity in dryers is that many commercially available sensors or probes which are capable of measuring humidity are sensitive to elevated temperatures and incapable of use at temperatures above about 220° F. Above about this temperature, damage to the sensors or probes is likely to occur, and commercial dryers operate at much higher temperatures, for instance up to about 800° F. or higher. Systems have been designed that continuously draw a filtered sample from a dryer and cool it to within a permissible probe temperature range, one such system being shown in prior U.S. Pat. No. 2,643,464 to Hadady. However, conventionally such systems are complicated, some being based on dilution of the sample gas with compressed gas, are expensive to buy and difficult to operate. Also, particular care must be taken in cooling the sample gas, as condensation of moisture within the gas and contact of the moisture with the humidity sensor or probe can invalidate the humidity reading.

In prior U.S. Pat. No. 2,987,918 to Hanna, there is shown a system for determining absolute humidity of gases. In the system, two humidity sensing devices are employed with means for cooling separate gas samples transmitted to the two sensing devices. The cooling means are connected in series so that the temperature of one gas sample is lower than or equal to the temperature of the other gas sample. The humidity sensing devices operate on the principle of measuring absolute humidity or dewpoint by a chemical hygrometer, specifically one in which a current flow in a winding is established proportional to humidity. The signal produced is proportional to the equilibrium temperature established in the winding.

SUMMARY OF THE INVENTION

The above and other disadvantages are overcome in accordance with the concepts of the present invention, in the provision of a control system for dryers comprising a means for sampling the dryer air including an intake opening in communication with the dryer air, an exhaust opening, a sampling chamber, and intake and exhaust conduits between said sampling chamber and intake and exhaust openings, respectively. Means are provided for maintaining the sampling chamber at a controlled temperature and to cool the incoming gases to approximately the temperature of said chamber, said system further including a humidity probe in the sampling chamber producing a signal proportional to the humidity therein. Means are then provided responsive to said signal for controlling the amount of fresh air make-up introduced into the dryer.

Cooling of the dryer gas sample preferably is carried out by means of a cooling coil interposed in the intake conduit means, and a controller for said cooling coil responsive to the surface temperature of the cooling coil. In this way, overcooling of the coil and condensation of moisture in the incoming dryer gas is prevented, in turn preventing invalidation of the humidity probe reading.

An aspect of the present invention resides in maintaining the flow of dryer air through the sampling circuit by means of an aspirator positioned in the circuit, the aspirator in turn being actuated by a compressor external to the circuit. Means are provided for employing the compressor flow for purge of the sampling circuit prior to and/or subsequent to dryer air sampling.

The present invention operates preferably on the principle of measuring absolute humidity or dewpoint by a chemical hygrometer. A specific such hygrometer is one shown in prior U.S. Pat. No. 2,987,918 (incorporated by reference herein), in which a current flow proportional to humidity is established in a winding, this current flow in turn establishing an equilibrium temperature measurement of the temperature providing a reading proportional to the absolute humidity or dewpoint.

BRIEF DESCRIPTION OF THE DRAWINGS

The invention and advantages will become more apparent upon further consideration of the following specification, with reference to the accompanying drawings, in which:

Referring to FIG. 1, there is illustrated a humidity sampling system in accordance with the concepts of the present invention, broadly identified by the numeral 12. The sampling system is positioned primarily on the outside of a dryer wall 14, shown in cross-section, through which a sample taking probe or intake 16 extends into the interior 18 of the dryer. An air filter 20, of any conventional design, is positioned over the end of the intake 16, dryer air being drawn through the air filter into the intake. Also, the intake is provided with a check valve 22, which closes off the same against reverse direction flow therein, from the humidity sampling system 12 back into the dryer, for reasons to be described. The check valve 22 can be positioned inside of the dryer as shown or outside the dryer.

Figure 1:
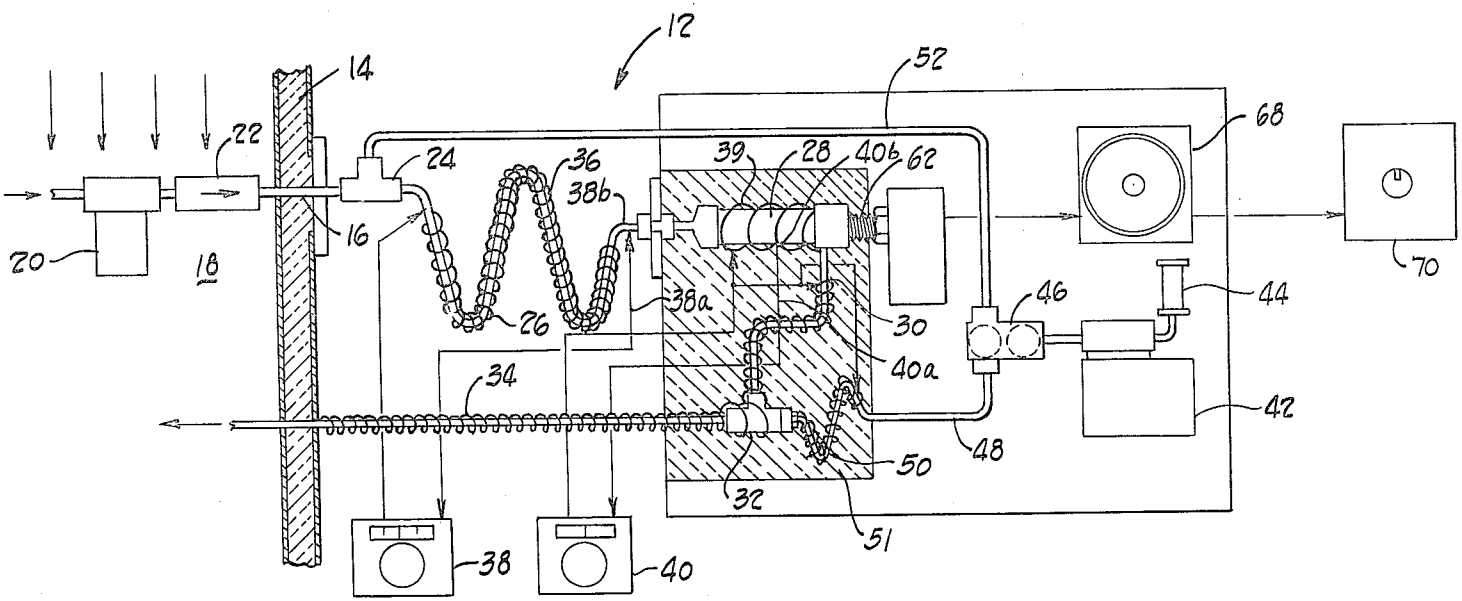
FIG. 1 is a schematic, elevation, partial section view illustrating a humidity sampling system in accordance with the concepts of the present invention.

The basic components of the humidity sampling system are a tee-fitting 24 into which the intake leads, a cooling coil 26 connected to an opposite opening of the tee-fitting, a sampling chamber 28 connected to the downstream end of the cooling coil, line 30 leading from the sampling chamber to an aspirator 32, and an exhaust line 34 leading from the aspirator exhaust port back to the dryer interior 18. The aspirator could exhaust to atmosphere or elsewhere, if desired.

In the flow path, the cooling coil 26 is a conventional coil, in the embodiment illustrated, about five feet in length, adapted to be cooled by natural convection of ambient air around the coil, at about 84° F. In this particular embodiment, the dryer gas may be at about 300° F., and the length of the coil is sufficient to cool the dryer gas more than necessary. In this regard, the gas may have a dewpoint of about 160° F. To avoid cooling to below dewpoint temperature causing condensation in the gas, the cooling coil is wrapped with a conventional heat tape 36. An example of such a heat tape is one manufactured by Clayborn Labs Inc., of Carson City, Nevada, identified as an electrical resistance heater of the pressure sensitive tape-on type. In this embodiment, the heat tape is controlled by a temperature controller 38 adapted to heat the surface of the cooling coil and prevent the gas from dropping below dewpoint temperature. The temperature controller illustrated is one manufactured by Gulton Industries Inc. of East Greenwich, Rhode Island, identified as West Model 10. The temperature controller has a 10 amp, time proportioning control and utilizes a thermocouple sensor having a range of 0°–300° F. An important aspect of the present invention resides in regulating the cooling coil temperature in response to surface temperature of the coil, instead of in response to gas temperature within the coil. This is accomplished by contact of the controller thermocouple lead **38*a* with the cooling coil surface at point 38*b*. It would be possible, if the controller 38 were responsive to gas temperature, to still overcool, for instance from control lag, and cause condensation to occur within the coil. Also, since the coil is cooling the sample, that is, heat is flowing from the sample to the coil, the temperature of the coil is necessarily below that of the sample. If the gas temperature were set close enough to the dewpoint of the gas it would be possible for the coil to be cool enough to cause condensation. Condensation, as will be further described below, could result in a faulty humidity reading. The sampling chamber 28 is also wrapped with a heat tape 39, the same as that employed with the cooling coil 26. Here also, the heat tape is controlled by a temperature controller 40, similar to the controller 38 employed with the cooling coil. The purpose of the controller 40 is to maintain the temperature of the sampling chamber at a predetermined value, above dewpoint temperature. Lead 40*a* is connected to a thermocouple sensor affixed to the surface of the sampling chamber at point 40*b***.

Preferably the line 30 leading from the sampling chamber and the aspirator 32 plus exhaust line 34 are also wrapped with heating tape, controlled by the controller 40, as shown. The heat tape applied to these components is oversized or more than necessary, the purpose being simply to prevent condensation within these components. Thus, the same controller 40 can be used for the heat tape applied to these components as accurate control of the temperature of the gas within the components is not necessary.

In this regard, the exhaust gas is re-introduced back into the dryer. It is desirable to re-introduce it into the dryer in the form of a vapor. Liquid dripping onto the floor of the dryer could cause undesirable corrosion. If the exhaust gas is vented to atmosphere or to a drain, heating the components 30, 34 and 32 would not be necessary.

The driving force for actuation of flow in the humidity sampling system of the present invention comprises the aspirator 32 in combination with compressor 42. The compressor is arranged to initiate a flow from atmosphere through air filter 44, into a solenoid valve 46, flow line 48, heating coil 50, and from there into the aspirator. The heating coil 50 is also wrapped by heat tape controlled by controller 40. Here, as with the aspirator 32 and lines 30, and 34 the heat tape is oversized. The purpose of the heating coil is to ensure against condensation of the exhaust gas from the sampling chamber and to prevent corrosion within the dryer. Here also, if the exhaust gas is vented to atmosphere or a drain, this component could be omitted.

In the embodiment illustrated, certain main components of the humidity sampling system, namely the sampling chamber 28, the aspirator 32, the heating coil 50 and line 30 between the sampling chamber and aspirator, exhaust line 34 are encased in suitable insulation 51 to maintain relatively constant temperature of these components.

The solenoid valve 46 is also connected, in addition to flow line 48, to purge line 52 which leads to tee-fitting 24. Depending on the position of the solenoid valve, the output of compressor 42 is used to either drive the aspirator 32 or maintain a purge flow in the system to tee-fitting 24 and through cooling coil 26, sampling chamber 28, line 30 and to exhaust. Check valve 22 prevents loss of purge flow directly to the dryer, by-passing the above components.

Thus, in operation, the humidity sampling system of the present invention preferably has three modes. These are purge before sampling, sampling and purge after sampling. When the humidity sampling system is started, the system automatically goes into the purge before sampling mode. In this mode, the compressor forces air from the surroundings through the solenoid valve 46 into purge line 52 to the tee-fitting 24. The check valve 22 in response to a pressure differential automatically shuts off so that the purge air is passed through the cooling coil 26 to the sampling chamber 28, through line 30 to the aspirator and from there to the dryer. Temperature controllers 38 and 40 are in the "on" position to bring the cooling coil, sampling chamber, and other components to desired temperatures quickly warming these components. In this way, the possibility of condensation from moist dryer air caused by the latter contacting cold tubing is avoided. The length of the purge is governed by a timer which automatically converts the humidity sampling system to a sampling mode on completion of purge.

It is possible to avoid use of the purge before sampling mode, by simply heating the respective components using controllers 38 and 40 prior to sampling. However, the use of purge before sampling tends to create a relatively uniform temperature throughout the entire system and tends to eliminate isolated cold spots.

The importance of preventing condensation, particularly upstream of the sampling chamber 28, is critical. Again, condensation upstream of the sampling chamber could invalidate humidity sensor readings.

In the sampling mode, the humidity sampling system continuously draws air from the dryer and cools the air to a temperature which is above dewpoint, but approximately that called for in sample chamber 28. In this regard, the dryer air or medium can be at any temperature, for instance in the range of about 300° to about 800° F. or even higher, depending upon the particular application involved. In the particular embodiment illustrated, the sampling chamber is designed to operate at a temperature of about 180° F. (inside the sampling chamber). Controller 38 is set to operate with a surface temperature at point **38*b* of about 165° F. Flow of dryer air in the system is accomplished by actuation of the solenoid valve 46 such that the compressor flow passes through heating coil 50 to aspirator 32, the flow through the aspirator drawing the flow in the dryer into probe 16, through the now open check valve 22. The flow of air through the cooling coil takes about two seconds to reach the sampling chamber 28**.

Figure 2:
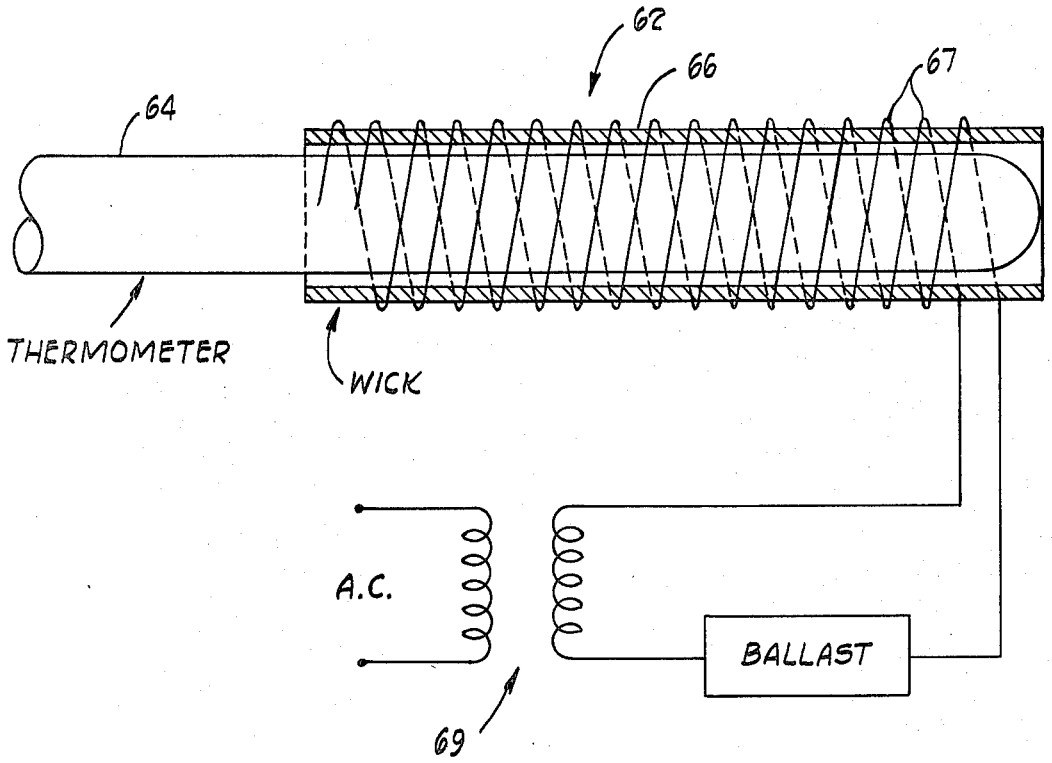
FIG. 2 is an enlarged elevation view of a humidity probe which can be used in the sampling system of FIG. 1.

In the embodiment illustrated in FIG. 1, the dewpoint detection device employed is a relative humidity detector or sensing element adapted to determine absolute humidity or dewpoint of the gas within the sampling chamber 28. The device is one adapted to be threaded into the end of the sampling chamber, one such device being marketed by Honeywell, Inc. under the trademark "Dewprobe", Model No. SST12P129B021. A similar such device is marketed by Foxboro Corporation under the trademark "Dewcell". The sensing element, identified by the numeral 62, in FIGS. 1 and 2, is a lithium chloride hygrometer which senses the dewpoint of the air and provides an output resistance which increases as the dewpoint increases. The element consists of a tube 64 (which may be metal) covered with a glass cloth 66 saturated with lithium chloride. A bifilar winding 67 of a suitable alloy is wrapped over the cloth. A power supply 69 provides an alternating current of a few volts to the bifilar winding. When the salt solution absorbs moisture, it conducts electricity between the windings causing a current to flow. This current produces heat which has the effect of evaporating some of the moisture on the sensing element. An equilibrium is reached when the moisture being absorbed by the salt is equal to the moisture being evaporated by the current. This equilibrium will be at a specific temperature higher than ambient temperature. A resistance thermometer inside the tube 64 (in the tube cavity) senses this temperature and provides a system output. The more moisture in the air, the higher the equilibrium temperature will be and the higher the resistance output. This resistance output is the input to a nickel bulb controller 68, which in turn provides an output for controlling a damper motor 70 adapted to control fresh air make-up and exhaust in the dryer.

After the gas leaves the sampling chamber it flows to aspirator 32, and from the aspirator, the mix of room and sample air is exhausted to the dryer by means of flow line 34.

An advantage in the arrangement illustrated is that the compressor 42 and solenoid valve 46 are outside the main stream flow of dryer gas and are not subjected to the high temperatures of dryer gas, with resulting loss of valve and compressor life. Conventional solenoid valves are not adapted to withstand high temperatures, for instance a 300° F. dryer gas temperature. In addition, the entire system is maintained at the desired temperatures necessary to prevent condensation, and also to obtain accurate dewpoint readings.

The temperature of the gas within the sampling chamber 28 is dependent primarily upon maximum temperature specifications for the humidity sensing element. In most such units, the maximum temperature can be exceeded somewhat at some loss in element life. However, by the present invention, inexpensive commercially available humidity sensing elements can be used with dryers operating at temperatures up to about 800° F. or higher. Higher dryer temperatures simply require longer cooling coils. Any number of humidity sensing elements can be employed in the sampling system of the present invention. For instance, a suitable humidity sensing element, particularly adapted for very high humidity gases, is one manufactured by EG&G Company, Model 440, identified as a hygrometer employing the primary chilled mirror technique, sometimes referred to as the continuous automatic dew-cup.

It should be understood that reference throughout this specification to dryer gas or dryer air embraces the use of treating mediums other than air or gas, these terms having been employed for convenience only. Also, the sampling system of the present invention is useful with equipment other than dryers, for instance with ovens, chemical process equipment where humidity measurements and control are important, bake ovens, and other such types of equipment. Still further, the sampling system of the present invention has broad application in sampling gases for conditions other than humidity, for instance where it is desirable to cool a gas sample while at the same time preventing condensation. An example of this application might be stack gas sampling.

In the purge mode of operation after sample taking, the flow of purge gas through the sample taking circuit is similar to the flow of purge gas in the purge mode of operation before sample taking; namely, the flow of gas is in purge line 52 to the tee 24, through the coil 26 into the sampling chamber 28, and from there through line 30, aspirator 32 and into the dryer. During this mode of operation, the controllers 38 and 40 are in the "on"

position so that the purge air is heated, maintaining the temperature of the system component parts above dewpoint temperature. In this way, the dryer gases are purged from the system without condensation occurring. Again, if condensation were to occur in the system, particularly upstream of the sampling chamber 28, faulty humidity readings could be obtained.

What is claimed is:

1. A control system for high temperature dryers comprising sample taking means for sampling the dryer air including an intake opening in communication with the dryer air;

a sampling chamber and intake conduit means between said sampling chamber and intake opening;

means for maintaining said sampling chamber at a controlled temperature, said intake conduit means including cooling means for cooling the incoming dryer sample air to approximately the temperature of said chamber, and heating means to prevent such cooling from going below dewpoint temperature;

means associated with said sampling chamber responsive to the humidity in said sampling chamber for producing a signal proportional to the humidity; and means responsive to said signal for controlling the amount of fresh air make-up introduced into the dryer and exhaust air emitted from the dryer.

2. The system of claim 1 wherein said intake conduit cooling means comprises a cooling coil adapted to be cooled by ambient air, said cooling coil being oversized with regard to the cooling load required for cooling the incoming gases, and electrical heating means to maintain said coil at a temperature above dewpoint temperature.

3. A control system for dryers comprising sample taking means for sampling the dryer air including an intake opening in communication with the dryer air;

a sampling chamber;

intake conduit means between said sampling chamber and intake opening;

exhaust conduit means leading from said sampling chamber;

aspirator means in said exhaust conduit means for maintaining a flow of dryer air through said sampling chamber and intake conduit means;

temperature control means for maintaining said sampling chamber at a controlled temperature;

cooling means associated with said intake conduit means for cooling the incoming dryer sample air to approximately the temperature of said chamber, heating to prevent such cooling from going below dewpoint temperature;

means associated with said sampling chamber responsive to the humidity in said sampling chamber for producing a signal proportional to the humidity; and means responsive to said signal for controlling the amount of fresh air make-up introduced into the dryer.

4. The system of claim 3 comprising compressor means for actuating said aspirator means; and purge means for passing purge air from said compressor means through said intake conduit means and sampling chamber in the same direction of flow as the dryer sample air, said purge means being operative when the intake conduit means and sampling chamber are free of flow of dryer sample air.

5. The system of claim 4 including means for heating said purge air.

6. The system of claim 3 wherein said temperature control means and cooling means are responsive to surface temperatures of the sampling chamber and intake conduit means, respectively.

7. The system of claim 6 wherein said exhaust conduit means is adapted to return sample air for admixture with dryer air, including means for maintaining said sample air prior to admixture at a temperature above sample air dewpoint temperature.

8. A sampling system for sensing a condition of a sample gas without condensation in said gas comprising sample taking means for receiving a sample of said gas including an intake opening in communication with said gas;

a sampling chamber and intake conduit means between said sampling chamber and intake opening;

means for maintaining said sampling chamber at a controlled temperature;

said intake conduit means including a cooling means for cooling the incoming gas to approximately the temperature of said chamber; and heating means for preventing such cooling from going below dewpoint temperature of said gas.

9. The system of claim 8 wherein said cooling means comprises a cooling coil adapted to be cooled by ambient air, said cooling coil being oversized with regard to the cooling load required for cooling the incoming gas; and electrical heating means to maintain said coil at a temperature above dewpoint temperature.

10. The system of claim 9 for sampling the humidity of said gas further comprising means associated with said sampling chamber responsive to the humidity of said gas in the sampling chamber adapted to produce a signal proportional to said humidity.

* * * * *

UNITED STATES PATENT AND TRADEMARK OFFICE

CERTIFICATE OF CORRECTION

PATENT NO. : 4,221,058

DATED : September 9, 1980

INVENTOR(S) : Peter E. Zagorzycki

It is certified that error appears in the above—identified patent and that said Letters Patent is hereby corrected as shown below:

Column 7, line 55, Claim 3, after "heating" add -- means --.

Signed and Sealed this

*Twenty-third* Day of *December 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,221,058

DATED : September 9, 1980

INVENTOR(S) : Peter E. Zagorzycki

It is certified that error appears in the above-identified patent and that said Letters Patent are hereby corrected as shown below:

On the title page [73] Assignee:, the Assignee should be --Proctor & Schwartz, Inc., Philadelphia, Pennsylvania-- rather than "SCM Corporation, New York, N.Y.".

Signed and Sealed this

*Twenty-sixth* Day of *May 1981*

[SEAL]

*Attest:*

RENE D. TEGTMEYER

*Attesting Officer*

*Acting Commissioner of Patents and Trademarks*